US008721357B2

(12) United States Patent
Li et al.

(10) Patent No.: US 8,721,357 B2
(45) Date of Patent: May 13, 2014

(54) ELECTRONIC DEVICE CONNECTOR

(75) Inventors: Yue-Yong Li, Wuhan (CN); Li-Fu Xu, Wuhan (CN); Hui Yu, Wuhan (CN); Xin-Xiang Li, Wuhan (CN); Yong-Nian Chen, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 34 days.

(21) Appl. No.: 13/467,121

(22) Filed: May 9, 2012

(65) Prior Publication Data

US 2013/0052852 A1 Feb. 28, 2013

(30) Foreign Application Priority Data

Aug. 29, 2011 (CN) ..... 2011 1 0250744

(51) Int. Cl.
*H01R 13/62* (2006.01)

(52) U.S. Cl.
USPC ..... 439/358

(58) Field of Classification Search
USPC ..... 439/344, 357, 358
See application file for complete search history.

(56) References Cited

U.S. PATENT DOCUMENTS

| | | | | | |
|---|---|---|---|---|---|
| 4,682,837 | A * | 7/1987 | Thomas et al. | ..... | 439/344 |
| 5,462,457 | A * | 10/1995 | Schroepfer et al. | ..... | 439/736 |
| 5,613,869 | A * | 3/1997 | Erlich et al. | ..... | 439/344 |
| 5,685,731 | A * | 11/1997 | Lin | ..... | 439/344 |
| 6,322,386 | B1 * | 11/2001 | Tharp et al. | ..... | 439/344 |
| 6,398,576 | B1 * | 6/2002 | Hwang et al. | ..... | 439/354 |
| 7,128,594 | B2 * | 10/2006 | O'Connor et al. | ..... | 439/344 |
| 7,204,721 | B2 * | 4/2007 | Lundholm et al. | ..... | 439/676 |
| 7,431,604 | B2 * | 10/2008 | Waters et al. | ..... | 439/344 |
| 7,465,180 | B2 * | 12/2008 | Kusuda et al. | ..... | 439/352 |
| 7,695,303 | B2 * | 4/2010 | Chen et al. | ..... | 439/352 |
| 8,038,460 | B2 * | 10/2011 | Andres et al. | ..... | 439/344 |
| 2005/0054230 | A1 * | 3/2005 | Huang | ..... | 439/344 |

* cited by examiner

*Primary Examiner* — Gary Paumen
(74) *Attorney, Agent, or Firm* — Novak Druce Connolly Bove + Quigg LLP

(57) ABSTRACT

A connector includes a body and a socket extending from the body. A blocking wall is located on the body. The socket includes a top wall, a resilient piece located on the top wall. The blocking wall is surrounded the resilient piece for preventing the resilient piece from destroying.

20 Claims, 3 Drawing Sheets

ELECTRONIC DEVICE CONNECTOR

BACKGROUND

1. Technical Field

The present disclosure relates to connectors, and particularly to a connector used in an electronic device.

2. Description of Related Art

Many electronic devices, such as data storage devices, need a plurality of connectors. The connectors are usually connected to a plurality of cables, such as power cables or WLAN cables. Each of the connectors may include a resilient piece to prevent the connectors from disengaging from the electronic devices. The resilient piece may be damaged by the cables around the connectors, so that the connectors may be easily disengaged from the electronic devices.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
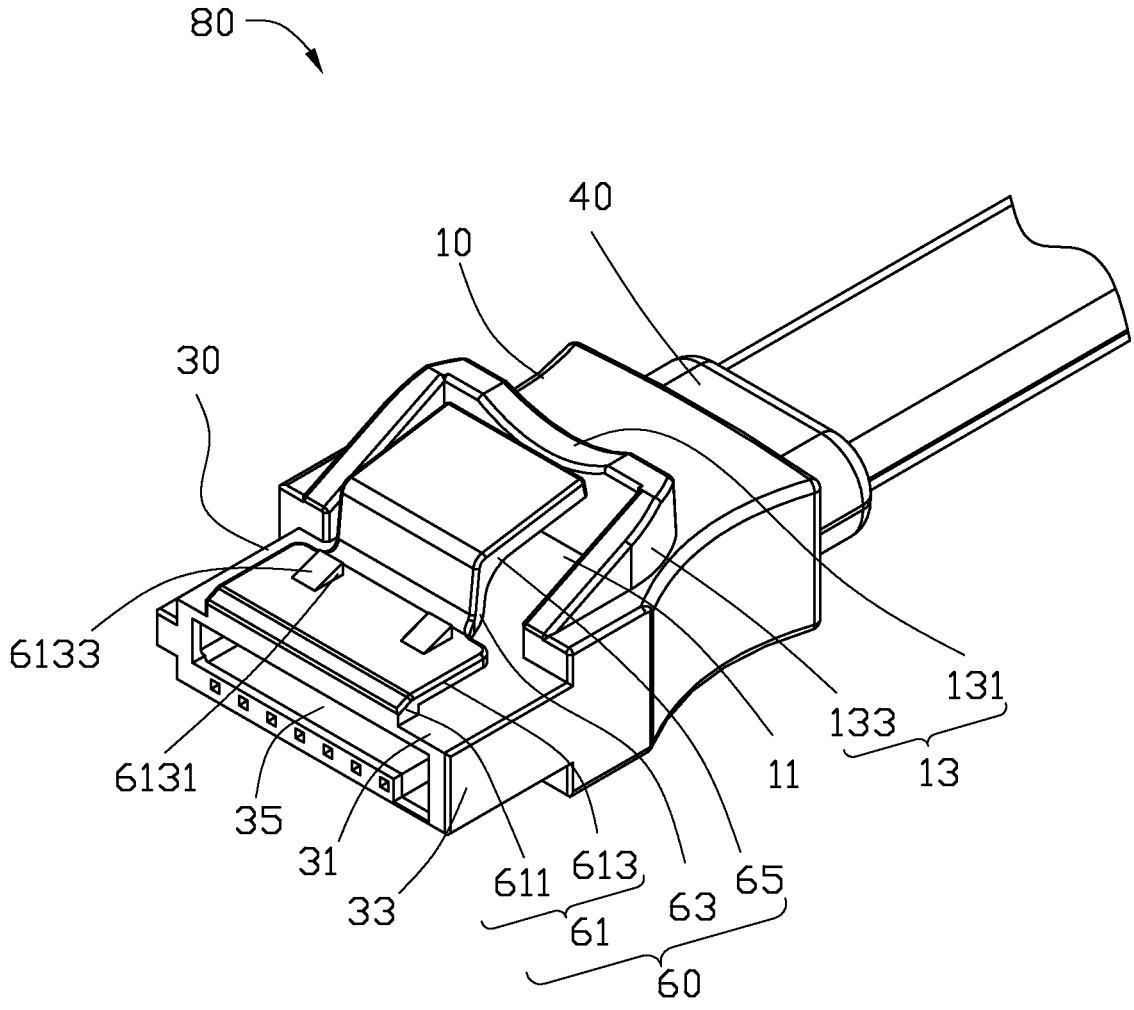
FIG. 1 is an isometric view of a connector.

Referring to FIG. 1, a connector 80 of an embodiment includes a body 10, a socket 30 extending from the body 10 and a cable 40 integrated with the body 10. The cable 40 may be, for example, a power cable or a WLAN cable, etc.

The body 10 defines a recess 11 extending to the socket 20. A blocking wall 13 protrudes from the body 10 and placed around at the edge of the recess 11. The blocking wall 13 includes a back wall 131 and two defending walls 133 located on two opposite sides of the back wall 131.

The socket 30 includes a top wall 31, a bottom wall (not shown) opposite to the top wall 31, a first sidewall 33 and a second sidewall (not labeled) opposite to the first sidewall 33. In one embodiment, the first sidewall 33 is substantially parallel to the second sidewall and perpendicular to the top wall 31. The top wall 31, the bottom wall, the first sidewall 33 and the second sidewall cooperatively define a receiving space 35. A plurality of first terminals (not shown) are located on the receiving space 35. A resilient piece 60 is located on the top surface of the top wall 31. In one embodiment, the bottom of the recess 11 is in the same plane as the top surface of the top wall 31. A positioning portion 331 (shown in FIG. 2) is located on the second sidewall.

The resilient piece 60 includes an engaging portion 61, a connecting portion 63, and an operating portion 65. The engaging portion 61 and the operating portion 65 are separately located on two opposite sides of the connecting portion 63.

The engaging portion 61 includes a raising portion 611 and a resilient portion 613. The raising portion 611 is connected to the top surface of the top wall 31. The resilient portion 613 extends towards the recess 11 from a distal end of the raising portion 611. A first plane is containing the top surface of the top wall 31. In one embodiment, the resilient portion 613 is substantially parallel to the first plane. Two protrusions 6131 are located on the top surface of the resilient portion 613. Each of the two protrusions 6131 has a guiding surface 6133. The guiding surface 6133 tilts away from the connecting portion 63. A second plane contains the guiding surface 6133. In one embodiment, an acute angle is defined between the second plane and the resilient portion 613.

The connecting portion 63 extends from a distal end of the resilient portion 613. In one embodiment, a first obtuse angle is defined between the connecting portion 63 and the resilient portion 613, and a second obtuse angle is defined between the first plane and the connecting portion 63. The operating portion 65 extends towards the back wall 131 from a distal end of the connection portion 63. A first distance is defined between the first plane and the resilient portion 613. A second distance is defined between the operating portion 65 and the first plane. In one embodiment, a third obtuse angle is defined between the connecting portion 63 and the operating portion 65; the second distance is larger than the first distance.

Figure 2:
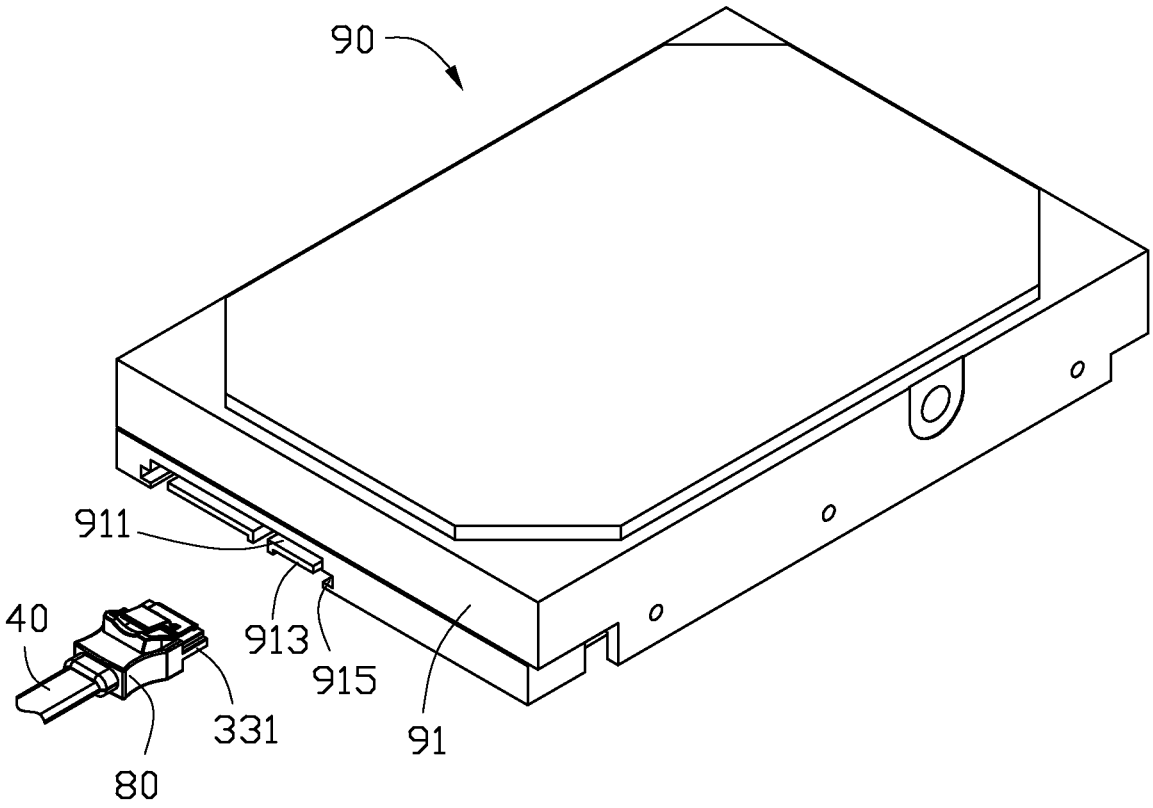
FIG. 2 is an exploded, isometric view of an embodiment of the connector of FIG. 1 and a data storage device.
Figure 3:
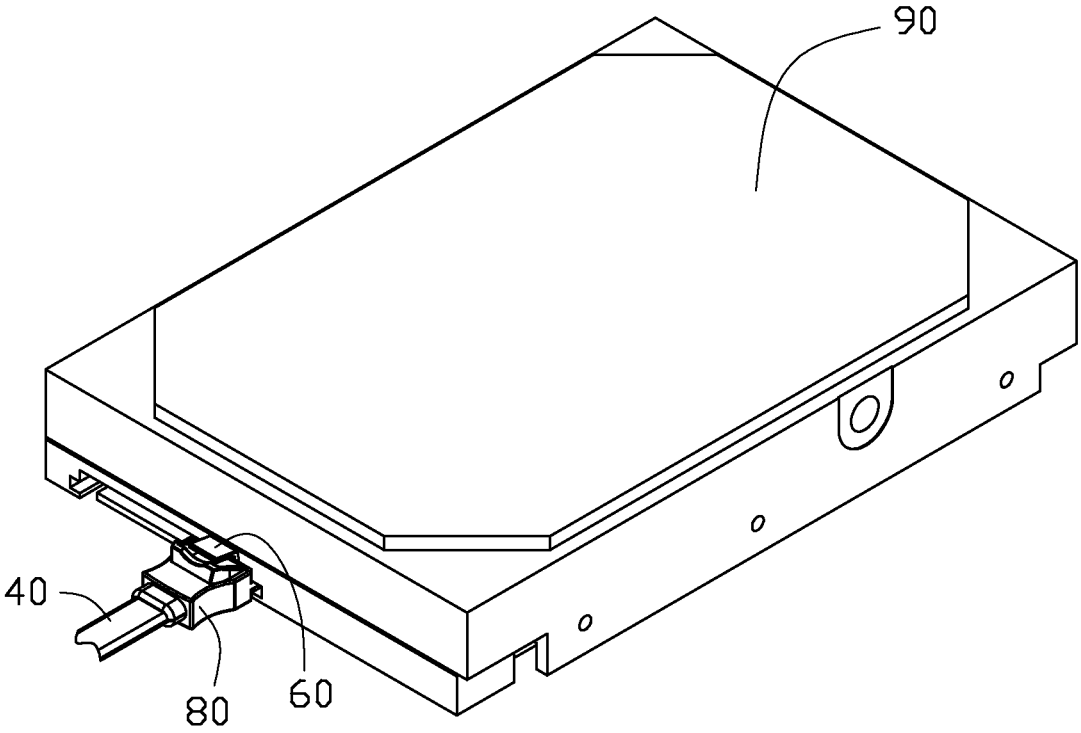
FIG. 3 is an assembled view of the connector and the data storage device of FIG. 2.

Referring to FIGS. 2-3, the connector 80 is configured to insert into a data storage device 90. The data storage device 90 includes an end portion 91. A port 911 is defined in the end portion 91. A sticking portion 913 extends from the end portion 91. A plurality of second terminals (not labeled) are located on the back surface of the sticking portion 913. A positioning groove 915 is defined in the end portion 91.

In assembly, the sticking portion 913 of the data storage device 90 is aligned with the receiving space 35. The positioning portion 331 is aligned with the positioning groove 915. The connector 80 is inserted into the port 911. The sticking portion 913 is engaged in the receiving space 35. The positioning portion 331 is engaged in the positioning groove 915. The first terminals are electrically connected to the second terminals. The resilient piece 60 is elastically engaged in the port 911. The operating portion 65 is received in the recess 11, and the blocking wall 13 is configured to prevent the cable 40 around the connector 80 from destroying the resilient piece 60.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A connector comprising:

a body, comprising a blocking wall located on the body;

a socket extending from the body, the socket comprising a top wall, and a resilient piece located on the top wall and comprising an engaging portion, a connecting portion extending from the engaging portion, and an operating portion extending from the connecting portion; the engaging portion and the operating portion being located on opposite sides of the connecting portion, the engaging portion comprising a raising portion connected to the top wall, and a resilient portion extending from the raising portion; a first distance being defined between a first plane containing a top surface of the top wall and the resilient portion, and the resilient portion being resiliently deformable to be configured to engage with a data storage device; wherein the blocking wall surrounds and protects the resilient piece.

2. The connector of claim 1, wherein the body defines a recess extending to the socket, and the resilient piece is configured to be received in the recess.

3. The connector of claim 2, wherein the blocking wall surrounds the recess and comprises a back wall and two defending walls connected to two opposite sides of the back wall.

4. The connector of claim 3, wherein the resilient portion is substantially parallel to the first plane.

5. The connector of claim 4, wherein the connecting portion extends from a distal end of the resilient portion, a first obtuse angle is defined between the connecting portion and the resilient portion, and the connecting portion is substantially perpendicular to the first plane.

6. The connector of claim 5, wherein a second obtuse angle is defined between the operating portion and the connecting portion.

7. The connector of claim 6, wherein the operating portion is substantially parallel to the resilient portion.

8. The connector of claim 7, wherein a second distance is defined between the operating portion and the first plane, and the second distance is greater than the first distance.

9. The connector of claim 8, wherein the blocking wall surrounds the operating portion.

10. The connector of claim 5, wherein two protrusions are located on the resilient portion; each of the two protrusions comprises a guiding surface, the guiding surface being tilted away from the connecting portion.

11. An electronic assembly comprising:

a data storage device, comprising a sticking portion located on the data storage device, and a port defined in the data storage device;

a connector, the connector comprising a body, a socket extending from the body and defining a receiving space, a resilient piece located on the socket and comprising an engaging portion, a connecting portion extending from the engaging portion, and an operating portion extending from the connecting portion; the engaging portion and the operating portion being located on opposite sides of the connecting portion, the engaging portion comprising a raising portion connected to the top wall, and a resilient portion extending from the raising portion; and a first distance being defined between a first plane containing a top surface of the top wall and the resilient portion; a blocking wall located on the body and surrounding the resilient piece; wherein the sticking portion is received in the receiving space, the socket is engaged in the port and configured to disengage from the port by elastically deforming the the resilient portion.

12. The electronic assembly of claim 11, wherein the body defines a recess extending to the socket, and the resilient piece is received in the recess.

13. The electronic assembly of claim 11, wherein the blocking wall comprises a back wall and two defending walls located on two opposite sides of the back wall.

14. The electronic assembly of claim 13, wherein the resilient portion is substantially parallel to the first plane.

15. The electronic assembly of claim 14, wherein a first obtuse angle is defined between the connecting portion and the resilient portion.

16. The electronic assembly of claim 15, wherein a second obtuse angle is defined between the operating portion and the connecting portion.

17. The electronic assembly of claim 16, wherein the operating portion is substantially parallel to the resilient portion.

18. The electronic assembly of claim 17, wherein a second distance is defined between the operating portion and the first plane, and the second distance is greater than the first distance.

19. The electronic assembly of claim 18, wherein the blocking wall surrounds the operating portion and protects the resilient piece.

20. The electronic assembly of claim 15, wherein two protrusions are located on the resilient portion, each of the two protrusions has a guiding surface, the guiding surface being tilted away from the connecting portion.

* * * * *